United States Patent [19]

Mizelle

[11] 4,398,705

[45] * Aug. 16, 1983

[54] BOX SPRING ASSEMBLY WITH INTERLOCKED FORMED WIRE SPRING COMPONENTS HAVING LIMITED DEFLECTION CAPABILITIES

[75] Inventor: Ned W. Mizelle, High Point, N.C.

[73] Assignee: Hoover Universal, Inc., Ann Arbor, Mich.

[ * ] Notice: The portion of the term of this patent subsequent to Jul. 20, 1999, has been disclaimed.

[21] Appl. No.: 240,763

[22] Filed: Mar. 5, 1981

[51] Int. Cl.[3] ..... F16F 3/00; A47C 23/02

[52] U.S. Cl. ..... 267/85; 267/103; 5/255; 5/247

[58] Field of Search ..... 267/85, 87, 97, 99, 267/103, 107, 179; 403/397; 24/261 R, 255 SL, 255 R; 5/252, 255, 256, 247, 267

[56] References Cited

U.S. PATENT DOCUMENTS

| | | | |
|---|---|---|---|
| 997,022 | 7/1911 | Tennant et al. | 403/397 |
| 3,359,019 | 12/1967 | Pinkney | 403/397 |
| 3,835,485 | 9/1974 | Klicki | 5/255 |
| 4,101,993 | 7/1978 | Yates et al. | 5/267 |
| 4,195,376 | 4/1980 | Kitchen | 5/255 |
| 4,207,634 | 6/1980 | Kitchen et al. | 5/255 |
| 4,339,834 | 7/1982 | Mizelle | 267/103 |

*Primary Examiner*—Robert J. Spar
*Assistant Examiner*—Robert Oberleitner
*Attorney, Agent, or Firm*—Stephenson and Boller

[57] ABSTRACT

A box spring assembly which includes a generally rectangular frame, a welded wire grid disposed above and aligned with the frame, a plurality of upwardly extending limited deflection wire springs which are mounted at their lower ends on the frame and at their upper ends are interlocked with the welded wire grid, and corner springs which are yieldable and are supported on the corners of the frame so as to support the corners of the grid. Each of the limited deflection springs is formed at its upper end with an attaching portion that is connected to the grid merely by moving it from an initial assembly position to an interlocked position, without the requirement of any notches in the grid. This structure enables assembly of the grid and the springs without the requirement for the usual attaching clips.

5 Claims, 4 Drawing Figures

BOX SPRING ASSEMBLY WITH INTERLOCKED FORMED WIRE SPRING COMPONENTS HAVING LIMITED DEFLECTION CAPABILITIES

BACKGROUND OF THE INVENTION

This invention relates generally to mattress foundation structures and more particularly to a box spring assembly of the type which utilizes non-coil springs. More particularly, this invention relates to a formed wire box spring which is an improvement on applicant's earlier box spring assembly of this type disclosed in U.S. patent application Ser. No. 131,935, filed Mar. 21, 1980 now U.S. Pat. No. 4,339,834. Reference to that application is made for a more detailed description of the background of box spring assemblies utilizing non-coil springs.

The present invention provides a box spring assembly that is an improvement because it utilizes a welded wire grid and supporting springs therefor that are different from the grid and spring assemblies heretofore used and disclosed in the above patent application. The supporting springs of this invention have self-locking tops which are arranged in an "over and under" relationship with a pair of crisscrossed wires in the grid. The springs are self-balancing in the sense that during assembly of the springs with the grid, all of the forces are in opposition to each other. The springs are self-orienting and tend to be self-centering, utilizing leaf spring tension at their upper ends for maintaining an assembly relation with the wire grid. The springs have limited deflection characteristics and, in addition, tend to be very stiff by virtue of their construction so that they normally do not bottom out on the frame. Novel corner springs yieldably support the corners of the welded wire grid on the corners of the supporting frame.

Further objects, features and advantages of this invention will become apparent from a consideration of the following description, the appended claims, and the accompanying drawing in which:

Figure 1:
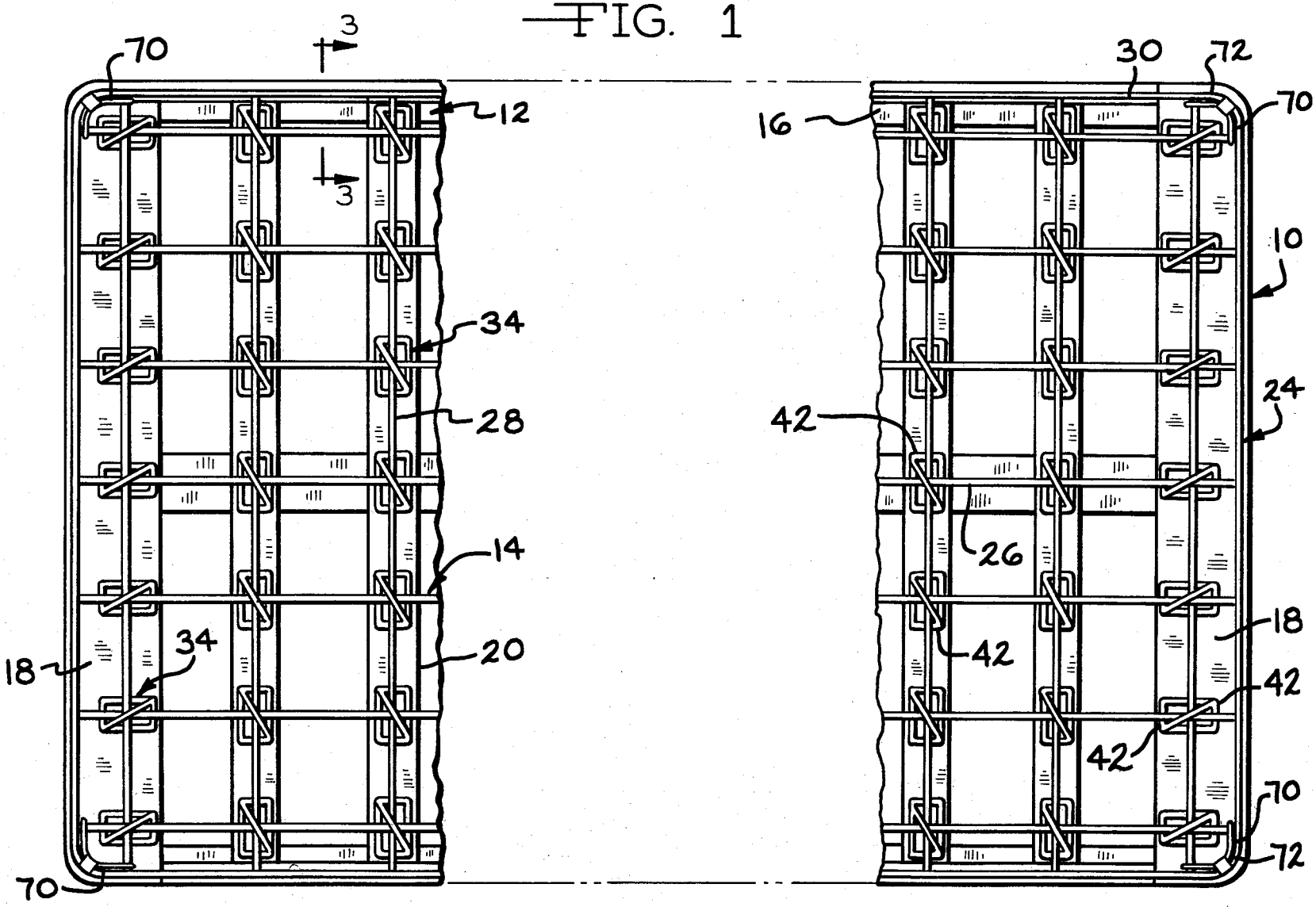
FIG. 1 is a plan view of the box spring assembly of this invention with the middle portion of the spring assembly being broken away for ease of illustration.
Figure 3:
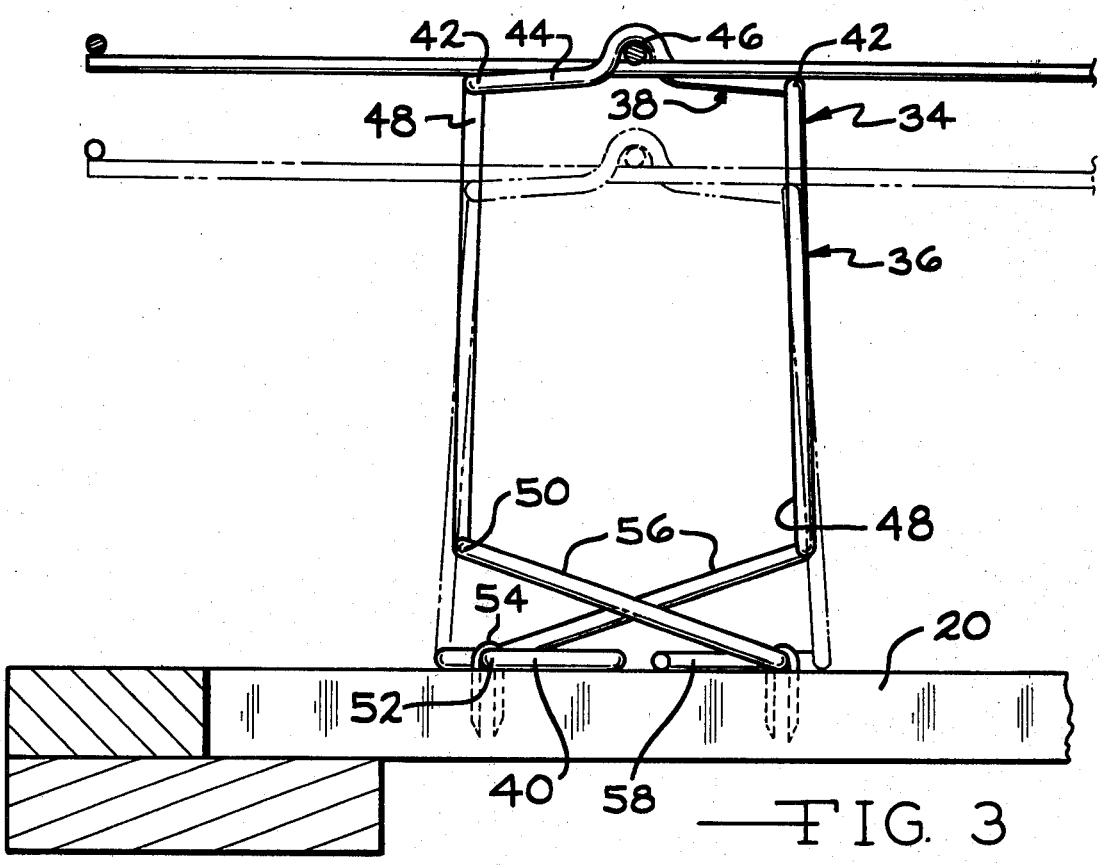
Figure 4:
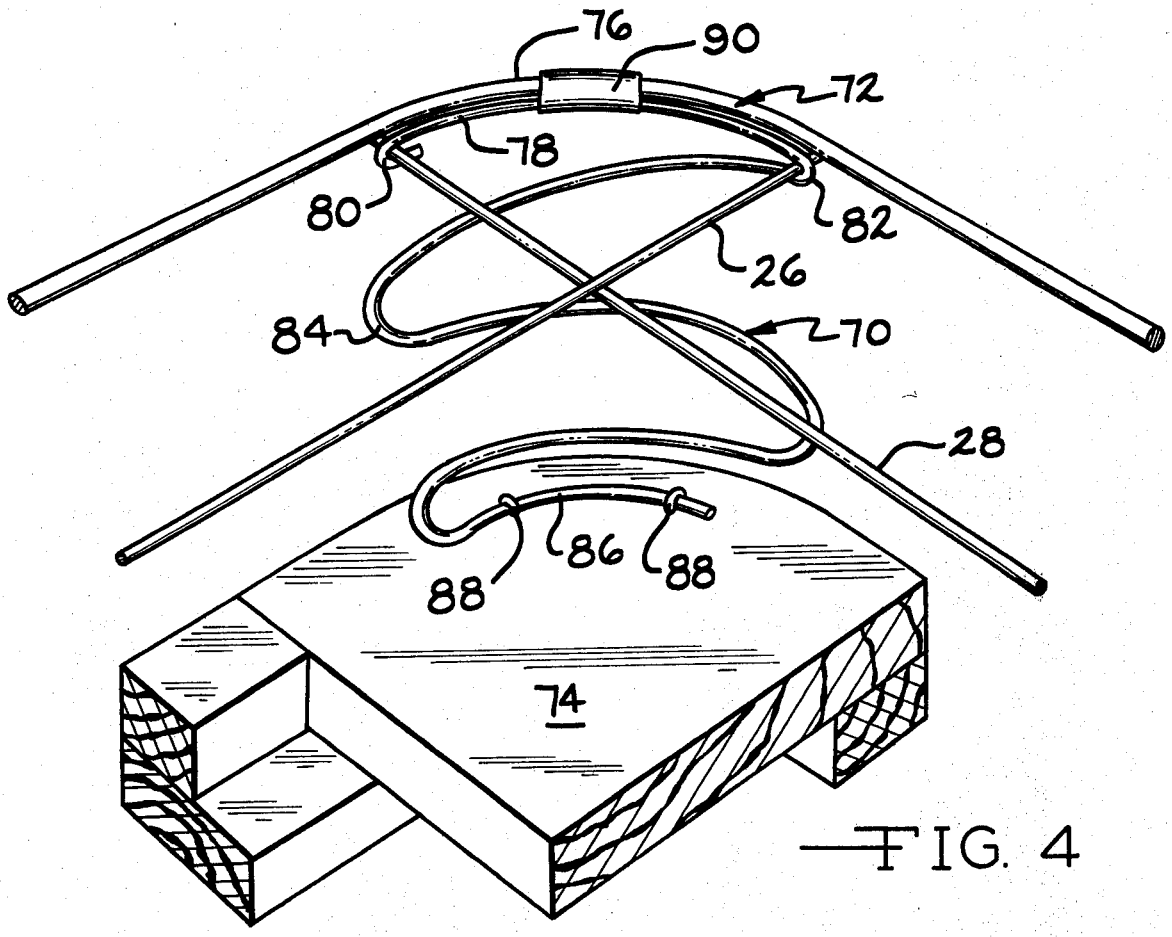

FIG. 3 is an enlarged fragmentary detail sectional view of a portion of the box spring assembly of this invention, as viewed from substantially the line 3—3 in FIG. 1, illustrating the spring component in the assembly and showing the spring in a deflected position in broken lines; and FIG. 4 is an enlarged fragmentary detail view of a corner of the spring assembly of this invention, illustrating the novel corner spring used in the assembly.

With reference to the drawing, the spring assembly of this invention, indicated generally at 10, is illustrated in FIG. 1 as consisting of a generally rectangular, horizontally disposed frame 12, usually formed of wood, and a wire spring assemblage 14 mounted on the top side of the frame 12. The frame 12 has side rails 16, end rails 18, and cross rails 20 which are secured to and extend between the side rails 16.

The spring assemblage 14 includes a horizontally disposed welded wire grid 24 which consists of a plurality of straight wires that are arranged crisscross fashion, some of the wires extending lengthwise of the frame 12 and being referred to hereinafter as "lengthwise wires 26" and some of the wires extending crosswise of the frame 12 and being hereinafter referred to as "crosswise wires 28". The wire grid 24 also includes a rectangular border wire 30 which is welded to the ends of the lengthwise wires 26 and the crosswise wires 28 which are in turn welded to each other at their junctures. The border wire 30 is of substantially the same size and shape as the frame 12.

The welded wire grid 24 forms a mattress support deck disposed in a horizontal plane at a predetermined distance above the frame 12. A plurality of limited deflection support springs 34, arranged in a regular pattern on the frame 12, yieldably support the grid 24 in this position above the frame 12 for yieldable movement toward the frame to accommodate bedding loads, namely, the mattress and the mattress occupants.

As best appears in FIG. 3, the springs 34, which are formed of spring wire and provide uniform support for the entire area of the deck 24 (FIG. 1) each consists of an upright yieldable portion 36 formed integral at its upper end with an attaching portion 38 and secured at its lower end 40 to one of the frame cross rails 20. The attaching portion 38 consists of a pair of parallel spaced spring wire sections 42 (FIG. 3) which are connected by a diagonally extending section 44. At its midpoint, the connecting section 44 is formed on its underside with a deep notch or notch-shape bend 46 for a purpose to appear presently.

The upright yieldable portion 36 consists of a pair of upright columns 48 that are substantially straight and substantially vertical and are formed integral at their upper ends with the parallel wire sections 42. At their lower ends, the columns 48 are formed integral with transversely extending torsion bars 50 that are substantially parallel to and are disposed directly below the parallel wire sections 42.

Torsion bars 52 at the lower end of the yieldable portion 36 are secured by staples 54 to the cross rail 20 and inclined connecting bars 56 extend between the torsion bars 50 and 52. The connecting bars 56 are reversely inclined relative to each other so as to be disposed entirely beneath the attaching portion 38. Conventional mounting feet 58 are formed integral with the torsion bars 52 and positioned in engagement with the cross rail 20 to provide for a stable mounting of the springs 34 on the frame 12.

Figure 2:
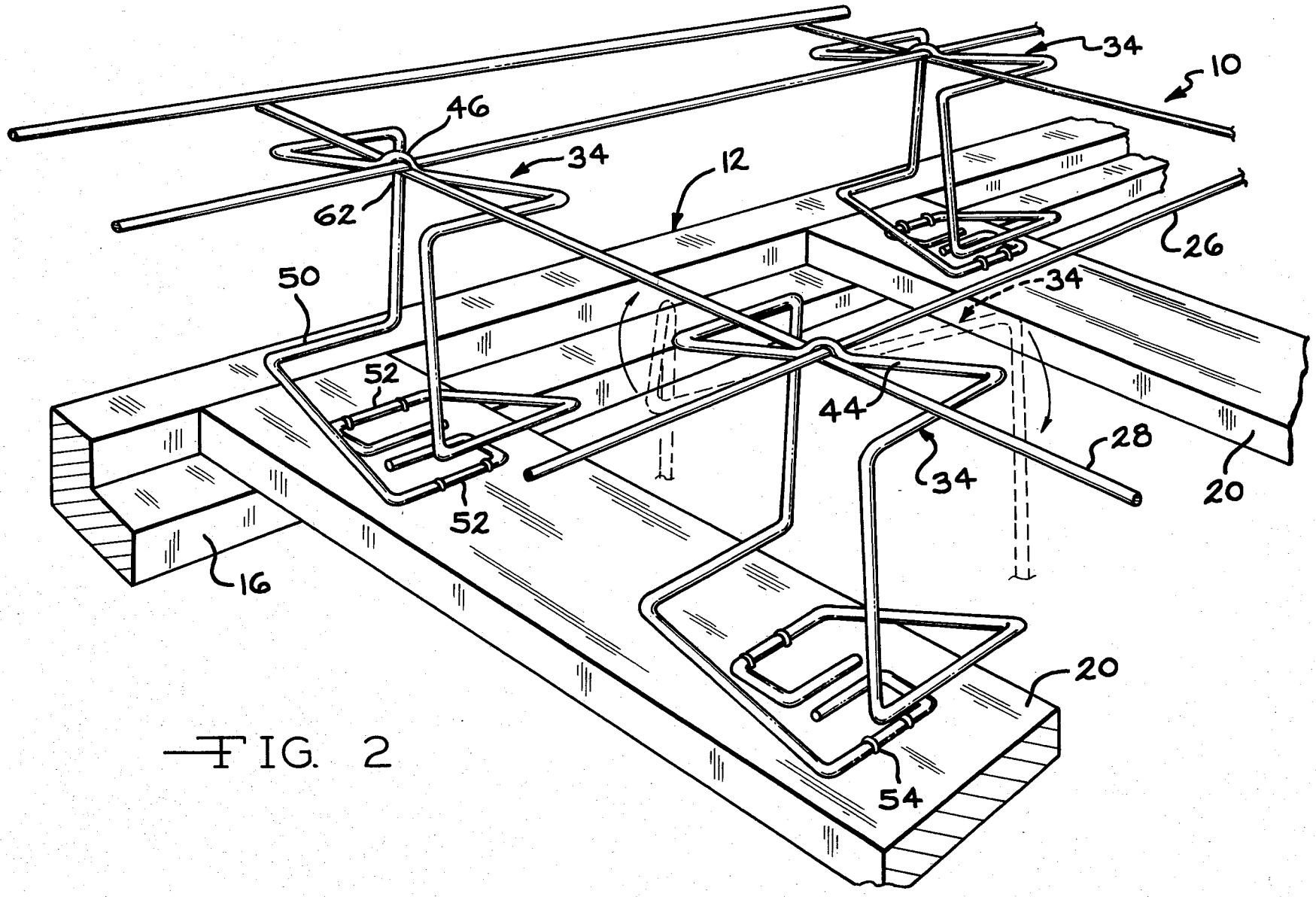
FIG. 2 is a fragmentary perspective view of a portion of the box spring assembly of this invention, illustrating the successive steps that are performed in the assembly of the springs with the wire deck and the supporting frame in the method of assembling the box spring assembly of this invention.

One of the advantages of the spring 34 in the formed wire box spring assembly 10 is the ability to assemble the springs 34 with the grid 24 without the requirement for attaching clips, which are normally required. In the assembly of a spring 34 with the frame 12 and grid 24, the spring 34 is first disposed above the juncture 62 of a lengthwise wire 26 and a crosswire 28, as shown in broken lines in FIG. 2. The spring 34 is then lowered to a position in which the notch 46 in the connecting section 44 is located at the juncture 62 on the top side of the lengthwise wire 26. The parallel wire sections 42 are located in diagonally opposite quadrants of the four-quadrant space formed by the intersecting wires 26 and 28 at the juncture 62, as also shown in broken lines in FIG. 2. At this time, the torsion bars 52 at the lower end of the spring 34 are adjacent the cross rail 20.

The spring attaching portion 38 is then rotated in a clockwise direction when viewed from above about a substantially vertical axis extending substantially through the juncture 62. During such rotation, the underside of the connecting section 44 at the notch 46 rotates on the top surface of the lengthwise wire 26 at the juncture 62. By virtue of the depth of the notch 46, greater than the diameter of grid wire 26 and 28 the parallel wire sections 42 are moved into engagement with the underside of the crosswise wire 28 in response to this rotation of the spring 34. Rotation is continued until the sections 42 are moved to positions in which the sections 42 are substantially centered with respect to the crosswise wire 28. This position of the spring attaching portion 38 provides for a "leaf-spring action" between the grid 24 and the spring attaching portion 38 to assure a frictional engagement of these parts that will maintain the spring 34 in a centered relation with the juncture 62. The spring 34 is thus self-centering, self-orienting and self-balancing on the grid 24. With the spring 34 in this position, the torsion bars 52 are then stapled on the top side of the cross rail 20.

As clearly appears in FIG. 1, all of the springs 34 that are supported on the cross rails 20 have their parallel connecting sections 42 arranged parallel to the lengthwise wires 26. The springs 34 that are mounted on the end rails 18, however, are turned ninety degrees with respect to the springs 34 that are mounted on the cross rails 20. This arrangement provides added support at the ends of the spring assembly 10 which is advantageous because the ends of a box spring assembly are often the portions of the bedding that are subjected to the highest loads.

In addition, in the box spring assembly 10 of this invention, yieldable corner springs 70 (FIGS. 1 and 4) are provided for supporting the corners 72 of the grid 24 on the corners 74 of the frame 12. As shown in FIG. 4, the corners 72 of the grid 24 consists of curved border wire sections 76. The top end of the corner spring 70 terminates in a curved wire section 78 that is positioned in a side-by-side relation with the curved section 76 of the border wire 30. A hook 80 on the end of the spring section 78 is hooked over the endmost cross wire 28 and a return bent-upon-itself portion 82 at the opposite end of the spring section 78 is hooked over the adjacent end of a lengthwise wire 26. The body 84 of the spring 70 then extends in a sinuous path downwardly from the portion 82 to terminate in a curved foot section 86 which lies flat against the frame corner section 74 and is secured thereto by staples 88. This construction of the corner spring 70 enables its easy assembly with the corner 72 of the welded wire grid 24. A hog ring type connector 90 is then extended about the adjacent wire sections 76 and 78 to secure the spring 70 to the corner 72. The provision of the corner springs 70 at all four corners 72 of the grid 24 provides for a firm yieldable support of the corners 72 on the frame 12 by virtue of the sinuous shape of the spring bodies 84 which are also curved in a vertical plane.

From the above description, it is seen that this invention provides an improved formed wire box spring assembly 10 in which the supporting springs 34 and 70 for the mattress support deck 24 are readily assembled with the deck without the requirement for the usual endless number of wrap-around clips. All that are required are the four connectors 90. Furthermore, in the spring assembly of this invention, no pre-notching of the grid wires 26 and 28 are required as in applicant's aforementioned copending application. This reduces the cost of fabrication and assembly and assures uniformity of support for the wire grid 24 on the frame 12 at all points over the top of the grid 24. The result is an improved box spring assembly which is easier to assemble, lighter in weight, and less expensive.

I claim:

1. In a box spring assembly which includes a generally horizontal rectangular frame having corners and a generally horizontal spring wire mattress support deck disposed a predetermined distance above said frame, said deck including a plurality of staight wires arranged criss-cross fashion, some of said wires extending lengthwise of said frame and others of said wires extending crosswise of said frame and a border wire having corner portions located above and substantially vertically aligned with the corners of said frame; a plurality of deck support springs arranged between said deck and said frame so as to yieldably support said deck on said frame, each of said springs including a vertically yieldable portion secured at the lower end to said frame and terminating at the upper end in a deck-attaching portion, each said deck attaching portion including a pair of generally parallel spaced wire sections and a connecting wire section integral with and extending diagonally between said spaced wire sections, each said attaching portion being located so that a mid portion of the connecting wire section therein is at the juncture of a lengthwise wire with a crosswise wire in said deck and the parallel wire sections extend crosswise of one of said crosswise or lengthwise wires on opposite sides of said juncture, said parallel wire sections and said connecting wire section being located on opposite top and bottom sides of the deck wires at said juncture so as to clamp said spring to said deck, and corner springs supported on and projecting upwardly from said frame corners, each said corner spring including an upright sinuous body terminating at the upper end thereof in an attaching portion arranged side-by-side with a border wire corner portion and attaching means connecting said side-by-side portions.

2. The box spring assembly according to claim 1 wherein said deck support springs are arranged in a regular pattern of rows parallel to said crosswise wires including two end rows at the ends of said frame, said spaced wire sections in the springs in said end rows being generally parallel to said crosswise wires and the spaced wire sections in the springs in the remaining rows being generally perpendicular to said crosswise wires.

3. The box spring assembly according to claim 2 wherein said crosswise and lengthwise wires are straight from end to end without any bends or notches.

4. A box spring assembly comprising a rectangular frame having side rails, end rails, and a plurality of cross rails that are generally parallel to each other and are substantially perpendicular to said side rails, means forming a deck consisting of a rectangular border wire positioned above and in substantial alignment with said frame, a plurality of substantially straight wires arranged criss-cross fashion within said border wire and welded to each other and to said border wire, some of said wires extending crosswire of said frame at positions directly above said cross rails and others of said wires extending lengthwise of said frame on top of said crosswise wires, a plurality of wire springs mounted on said cross rails and connected to said deck so as to yieldably resist downwardly directed bedding loads applied to the deck, each of said springs including a vertically yieldable portion secured at the lower end to one of said crossrails and terminating at the upper end in a deck attaching portion, each said deck attaching portion including a pair of generally parallel spaced wire sections and a connecting wire section integral with and extending diagonally between said spaced wire sections, each said attaching portion being located so that a mid portion of the connecting wire section overlies a lengthwise wire at the juncture of said lengthwise wire with a crosswise wire in said deck and the parallel wire sections extend crosswise of the crosswise wire at positions in engagement with the underside of said crosswise wire on transversely opposite sides of said juncture, whereby said parallel wire sections and said connecting wire sections are located on opposite top and bottom sides of said crosswise wires at said juncture so as to clamp said sring to said deck, and corner springs supported at the corners of said frame and supporting the corners of said border wire.

5. The box spring assembly according to claim 4 wherein the underside of said diagonal connecting wire section at the mid portion thereof is formed with a notch into which said lengthwise wire and crosswise wire at said juncture extend and the underside of said crosswise wire is uninterrupted and straight and said parallel wire sections forcefully engage said underside so that frictional forces therebetween maintain said parallel wire sections in fixed positions relative to said crosswise wire in a direction along the length thereof.

* * * * *